US007824515B2

(12) United States Patent
Ishida

(10) Patent No.: US 7,824,515 B2
(45) Date of Patent: Nov. 2, 2010

(54) METHOD FOR IMAGE FORMATION, INTERMEDIATE TRANSFER RECORDING MEDIUM, AND IMAGE FORMED OBJECT

(75) Inventor: Tadahiro Ishida, Shinjuku-Ku (JP)

(73) Assignee: Dai Nippon Printing Co., Ltd., Shinjuku-ku (JP)

( * ) Notice: Subject to any disclaimer, the term of this patent is extended or adjusted under 35 U.S.C. 154(b) by 1009 days.

(21) Appl. No.: 11/390,596

(22) Filed: Mar. 28, 2006

(65) Prior Publication Data

US 2006/0240202 A1 Oct. 26, 2006

(30) Foreign Application Priority Data

Mar. 30, 2005 (JP) ..... 2005-099272

(51) Int. Cl.
*B41M 5/26* (2006.01)

(52) U.S. Cl. ..... 156/235; 428/32.51; 428/32.76; 428/32.78; 430/2

(58) Field of Classification Search ..... None
See application file for complete search history.

(56) References Cited

U.S. PATENT DOCUMENTS 6,308,630 B1 * 10/2001 Kurokawa et al. ..... 101/492

* cited by examiner

*Primary Examiner*—Bruce H Hess
(74) *Attorney, Agent, or Firm*—Burr & Brown

(57) ABSTRACT

This invention provides a method for image formation, which can produce a thermally transferred image possessing excellent heat resistance and various fastness properties even under severe service conditions, and an intermediate transfer recording medium and an image formed object.

2 Claims, 5 Drawing Sheets

METHOD FOR IMAGE FORMATION, INTERMEDIATE TRANSFER RECORDING MEDIUM, AND IMAGE FORMED OBJECT

FIELD OF THE INVENTION

The present invention relates to a method for image formation. More particularly, the present invention relates to a method for image formation, which can produce a thermally transferred image possessing excellent heat resistance and various fastness properties even under severe service conditions, and an intermediate transfer recording medium and an image formed object.

The "ratio", "parts", "%", etc. as used herein in conjunction with formulation are by mass unless otherwise specified, and the mark "/" represents the state of being integrally laminated.

BACKGROUND OF THE INVENTION

Major applications of printed matters having an optically diffractive image transferred thereon by the method for image formation and intermediate transfer recording medium according to the present invention include, for example, output of images and output of a photograph of the face or the like onto identification, passports, credit cards, ID cards, or other cards.

An intermediate transfer recording medium comprising a transfer layer having both an optically diffractive image, such as a hologram or a diffractive grating, and a thermally transferable image is intended to improve security for forgery prevention, because the intermediate transfer recording medium can render, together with a thermally transferred image, unique decorative images and three-dimensional images, can realize a high level of design, and, at the same time, these holograms and diffractive gratings cannot be easily produced due to the necessity of a high level of production techniques. However, it should be noted that the application of the present invention is not particularly limited to those only so far as the applications require a high level of design and security.

There has been an increasing demand for the formation of both an optical diffraction structure and a thermally transferred image on a desired object (an object on which a structure or an image is to be transferred). To meet this demand, for example, the following method has been proposed.

Specifically, an intermediate transfer recording medium comprising a transfer layer provided separably on a base material is provided. The transfer layer comprises at least a peel layer, a relief formed layer having an optically diffractive, a transparent thin film layer having a refractive index different from the relief formed layer, and an image receptive layer. A colorant such as a dye or a pigment is transferred onto the surface of the image receptive layer using a thermal transfer sheet comprising a coloring material layer containing a heat-fusion ink or a dye to form a thermally transferred image. Thereafter, the intermediate transfer recording medium is heated to transfer the optically diffractive image and the thermally transferred image onto an object.

The image formed by this method is not present on the outermost surface and is in such a state that the image is protected by the peel layer, the relief formed layer and the like. In images used under severe conditions such as ID cards, however, a further improvement, for example, in fastness to abrasion, light, and plasticizer has been desired.

The present applicant has disclosed a method for image formation that can produce a thermally transferred image possessing excellent various fastness properties. In this method, an intermediate transfer recording medium comprising a transfer part, in which a hologram image has been set on at least every other image plane, is provided. An image is formed on the transfer part, and the transfer part is then transferred onto an object. Thereafter, a next transfer part in the intermediate transfer recording medium is again transferred at least once onto the object with the image formed thereon (see, for example, patent document 1).

Further, in order to prevent the occurrence of cracking or discoloration of a transparent thin film layer by heat and stress applied in the transfer of a transfer layer in an intermediate transfer recording medium onto an object, or a deterioration in surface appearance as a result of the appearance of a pattern due to cracking in the transparent thin film layer conformed to heat deformation of a base material in the whole transfer by a heat roller or the like, the present applicant has further disclosed an intermediate transfer recording medium with a hologram, comprising a base material and at least a peel layer formed of a heat-resistant transparent resin having high heat resistance, a relief formed layer, and a metal thin film layer stacked in that order on the base material (see, for example, patent document 2).

According to the conventional methods, the occurrence of cracking, discoloration, and cracking-derived pattern in the metal thin film layer can be prevented, and, thus, it is expected that the problem of deteriorated surface appearance is overcome. Since, however, the peel layer having a heat resistant surface is exposed, adhesion in the second transfer as described in patent document 1 onto the surface of the peel layer or in the stacking of other material onto the surface of the peel layer is disadvantageously poor.

In order to prevent the deterioration in surface appearance of the transparent thin film layer caused by heat applied in the transfer, a method for image formation and an intermediate transfer recording medium have been desired in which, even when the second transfer is carried out on the layer with the heat resistant peel layer formed thereon, the adhesion is maintained and, in addition, the protection of the thermally transferred image by a layer formed by the second transfer can provide an image formed object having both an optical diffraction structure and a thermally transferred image printed thereon in which the thermally transferred image possesses fastness properties high enough to withstand use under severe service conditions.

[Patent document 1] Japanese Patent Laid-Open No. 254840/2002

[Patent document 2] Japanese Patent Laid-Open No. 361622/2004

SUMMARY OF THE INVENTION

Accordingly, the present invention has been made with a view to solving the above problems of the prior art, and an object of the present invention is to provide a method for image formation, an intermediate transfer recording medium and an image formed object in which, even in a layer construction having a heat resistant peel layer adopted for preventing the deterioration in surface appearance of the transparent thin film layer caused by heat applied in the transfer, when the second transfer or the stacking of other material is carried out, the adhesion can be maintained and, in addition, the protection of the thermally transferred image by a layer formed by the second transfer can provide an image formed object having both an optically diffractive image and a thermally transferred image printed thereon in which the thermally transferred image possesses fastness properties high enough to withstand use under severe service conditions.

One embodiment of the invention is a method for image formation, comprising the steps of: (1) providing an intermediate transfer recording medium comprising at least a base material film and a transfer part provided separably on said base material film, said transfer part comprising at least an optical diffraction structure and an image receptive layer; (2) providing a thermal transfer sheet with an adhesive layer, comprising at least a base material film and, provided on said base material film, a thermally transferable coloring material layer for at least one color and a separably provided heat adhesive layer transfer part, said thermally transferable coloring material layer and said heat adhesive layer transfer part having been set; (3) forming a thermally transferred image on the surface of the image receptive layer in said intermediate transfer recording medium using the thermally transferable coloring material layer in said thermal transfer sheet with an adhesive layer; (4) transferring the transfer part with the thermally transferred image formed thereon onto an object; (5) transferring said heat adhesive layer part in said thermal transfer sheet with an adhesive layer onto the transfer part of an image plane next to the image plane of the intermediate transfer recording medium used in step (3) to form a heat adhesive layer; and (6) transferring the transfer part with the heat adhesive layer formed thereon in step (5) onto the object through the heat adhesive layer so as to cover the transferred part with the thermally transferred image formed thereon in step (4) on the object.

In a second embodiment, at least said transfer layer comprises a peel layer comprising a resin having a glass transition temperature of 150° C. or above, a relief formed layer, a transparent thin film layer having a refractive index different from the relief formed layer, and an image-receptive layer.

In a third embodiment, in said transfer part of the above intermediate transfer recording medium, an image plane having an optical diffraction structure and an image plane free from an optical diffraction structure are alternately set.

In a fourth embodiment, said transfer part in the above intermediate transfer recording medium has one or more types of optical diffraction structures.

In a fifth embodiment, said optical diffraction structure is a hologram or a diffraction grating and the thermally transferred image is an image formed by a heat-fusion transfer method or a thermal dye transfer method.

The present invention of the first embodiment can provide a method for image formation that, even in a layer construction having a heat resistant peel layer, good adhesion can be maintained in the second transfer.

The present invention of the second embodiment can provide an intermediate transfer medium in which, even in a layer construction having a heat resistant peel layer adopted for preventing the deterioration in surface appearance of the transparent thin film layer caused by heat applied in the transfer, when the second transfer or the stacking of other material is carried out, the adhesion can be maintained and, in addition, the protection of the thermally transferred image by a layer formed by the second transfer can provide an image formed object having both an optical diffraction structure and a thermally transferred image printed thereon in which the thermally transferred image possesses fastness properties high enough to withstand use under severe service conditions.

The invention of the third embodiment can provide an intermediate transfer recording medium that, in addition to the effect attained by the intermediate transfer recording medium of the second embodiment, has an additional effect that durability against the second transfer is excellent.

The invention of the fourth embodiment can provide an intermediate transfer recording medium that, in addition to the effect attained by the intermediate transfer recording medium of the second embodiment, has an additional effect that two or more types of optical diffraction structures can be transferred.

The invention of the fifth embodiment can provide a method for image formation that, since an optical diffraction structure such as a hologram or a diffractive grating in addition to the thermally transferred image is provided, a high level of design, which can render unique decorative images and three-dimensional images, and a high level of security for forgery prevention can be realized.

The invention can provide an image formed object in which, even in a layer construction having a heat resistant peel layer adopted for preventing the deterioration in surface appearance of the transparent thin film layer caused by heat applied in the transfer, when the second transfer or the stacking of other material is carried out, the adhesion can be maintained and, in addition, the protection of the thermally transferred image by a layer formed by the second transfer can provide an image formed object having both an optical diffraction structure and a thermally transferred image printed thereon in which the thermally transferred image possesses fastness properties high enough to withstand use under severe service conditions.

DESCRIPTION OF REFERENCE CHARACTERS

Figure 1:
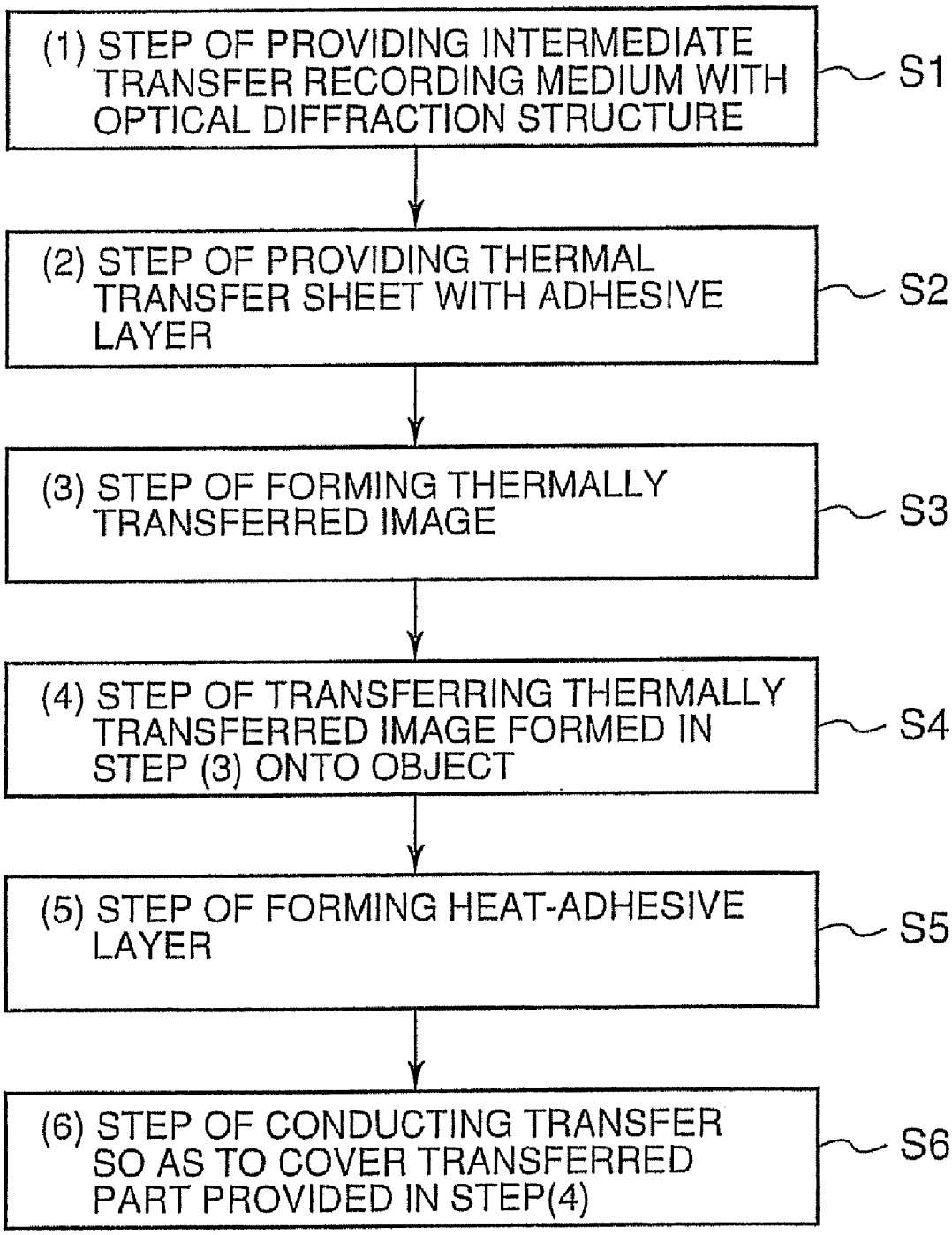
FIG. 1 is an explanatory view illustrating steps in a method for image formation according to the present invention.

10: intermediate transfer recording medium
11: base material
12: primer layer
13: peel layer
14: release layer
15: relief formed layer
17: transparent thin film layer
19: receptive layer
21A, 21B: transfer layer region with optically diffractive image
21AA: transfer layer with optically diffractive image
21X: transfer layer region without optically diffractive image
21XX: transfer layer without optically diffractive image
30: thermal transfer sheet with adhesive layer
31Y, 31M, 31C, 31K: coloring material layer region
31YY: Y coloring material layer
33: heat-adhesive layer region
35: heat-adhesive layer
100: image formed object
101: object

DETAILED DESCRIPTION OF THE INVENTION

Embodiments of the present invention will be described in more detail with reference to the accompanying drawings.

Method for Image Formation

Figure 2A:
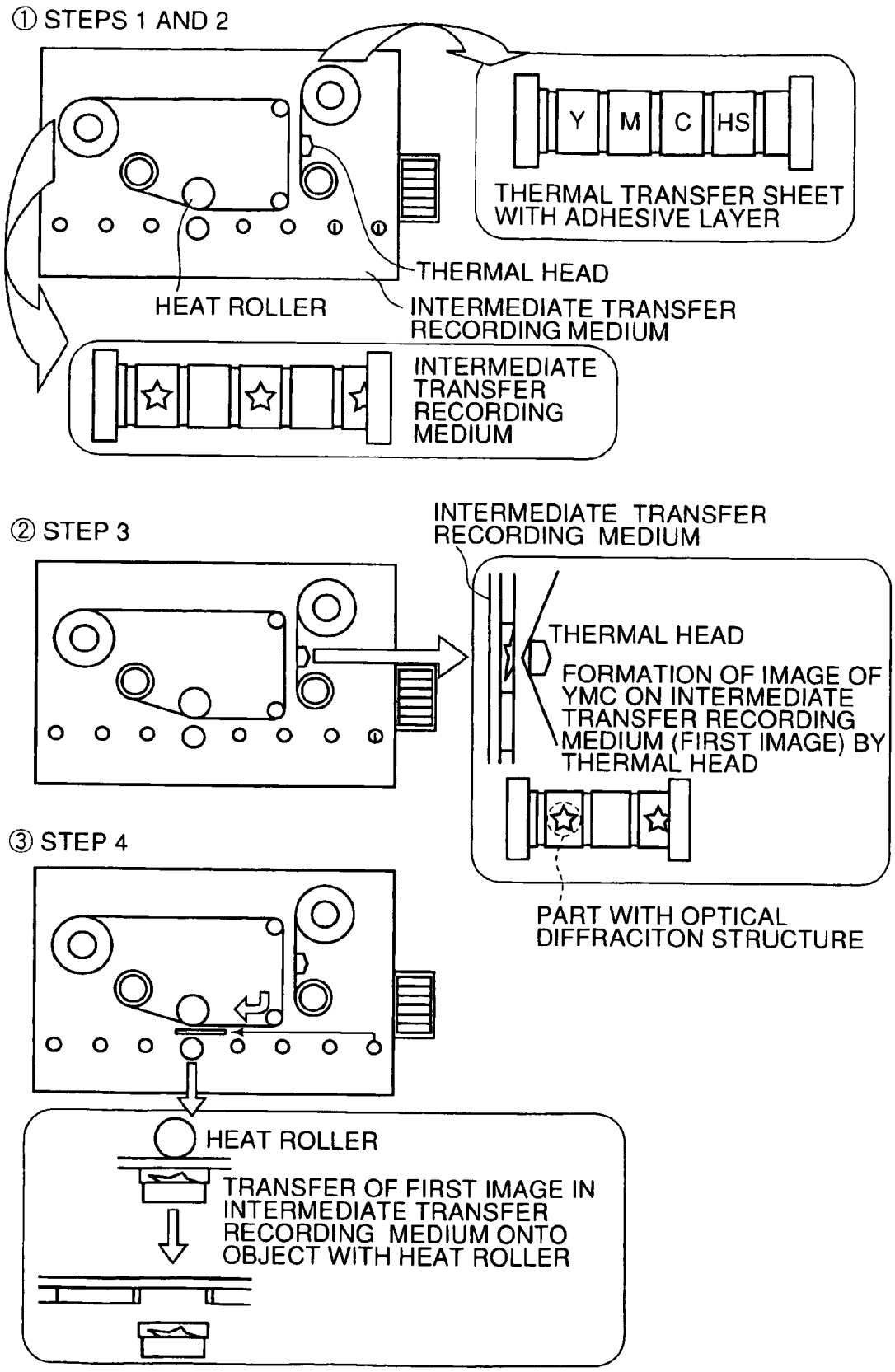
FIG. 2A is an explanatory view diagrammatically illustrating steps in a method for image formation according to the present invention.
Figure 2B:
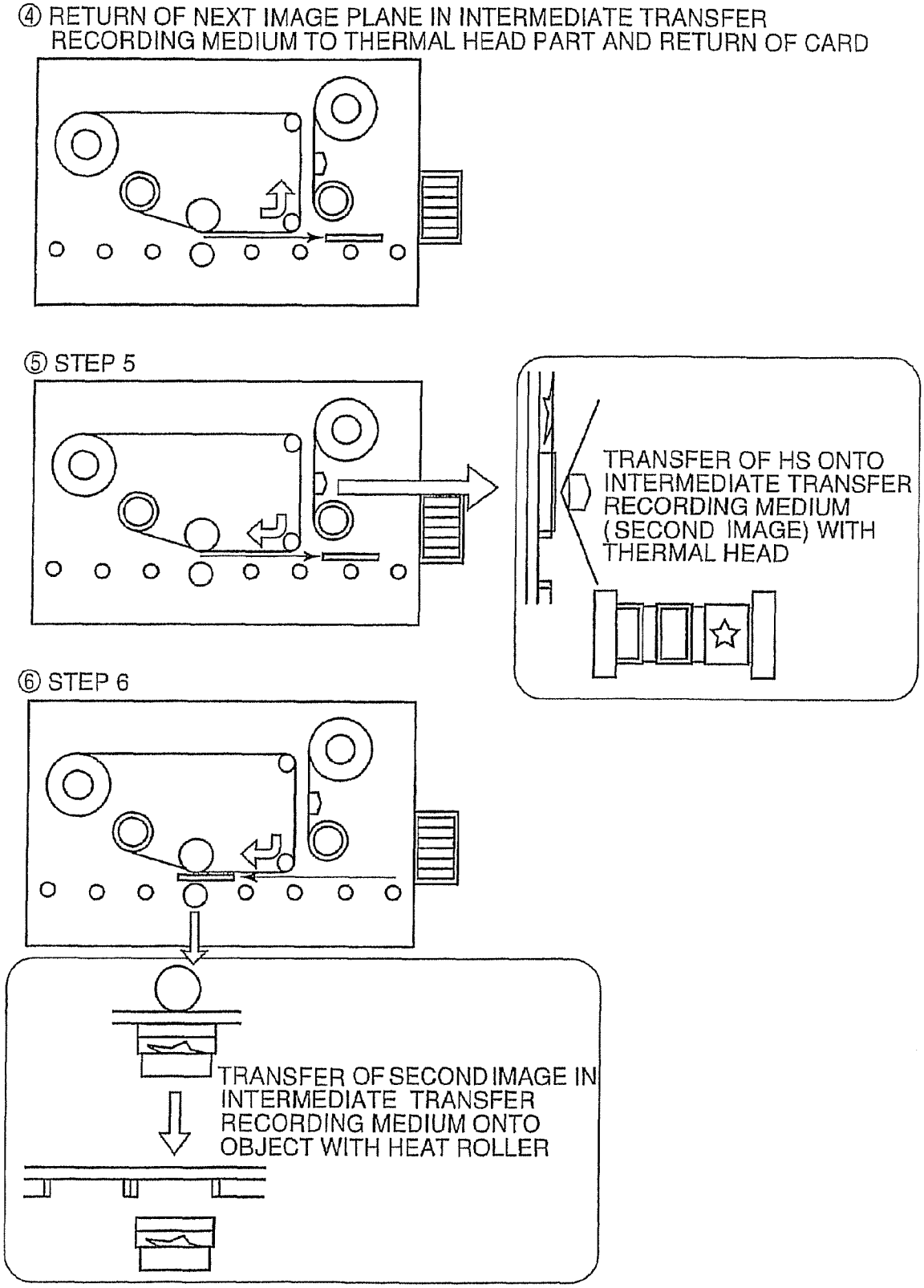
FIG. 2B is an explanatory view diagrammatically illustrating steps in a method for image formation according to the present invention.

As shown in FIG. 1 and diagrammatically shown in FIG. 2, the method for image formation according to the present invention comprises the following steps (1) (S1) to (6) (S6). The intermediate transfer recording medium provided in step (1) is an intermediate transfer recording medium according to the present invention. The method for image formation according to the present invention including the medium will be described in the order of steps.

Step S1 is (1) the step of providing an intermediate transfer recording medium comprising at least a base material film and a transfer part provided separably on the base material film, an optical diffraction structure being set in at least every other image plane in the transfer part.

Figure 3:
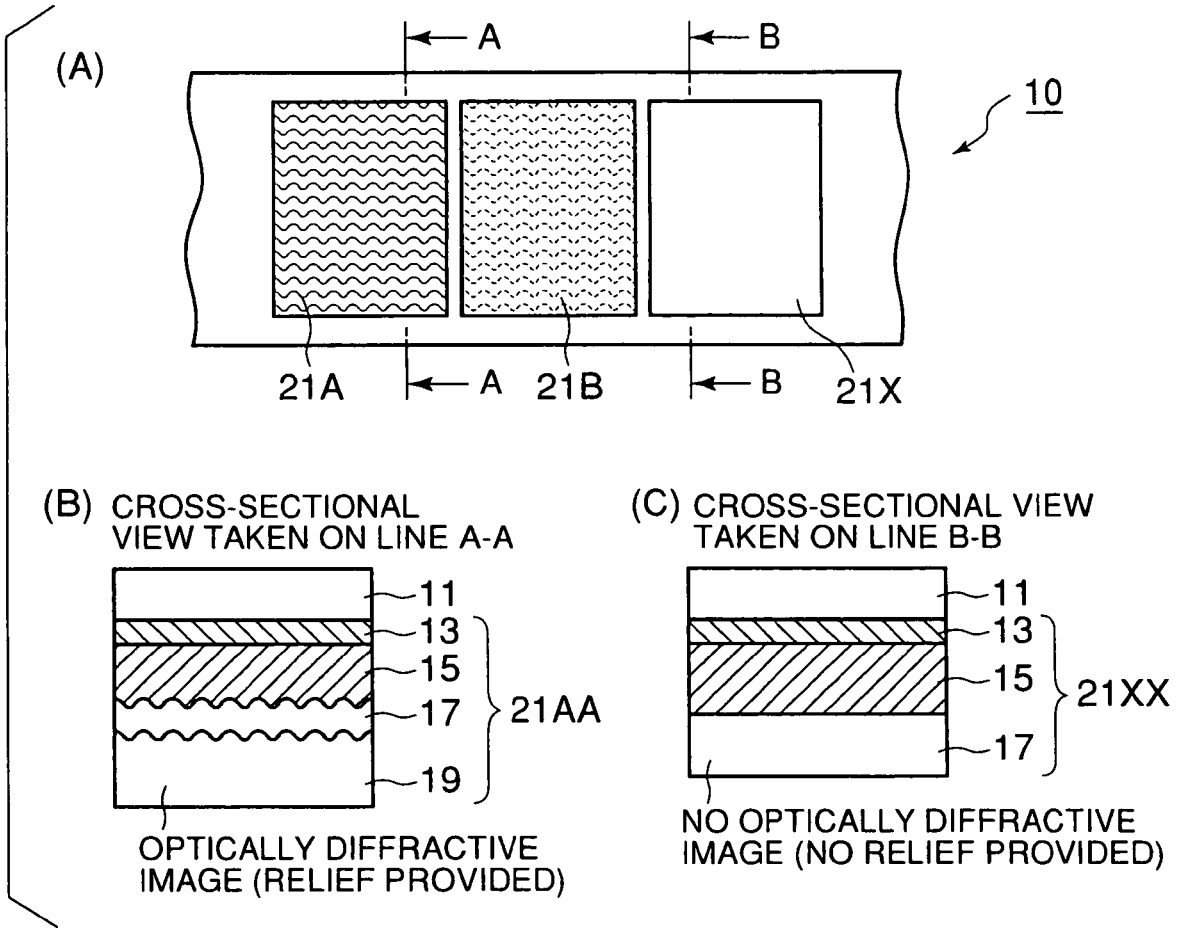
FIG. 3 is a plan view and a cross-sectional view of an intermediate transfer recording medium with an optically diffractive image according to the present invention.

As shown in FIG. 3 (A), an intermediate transfer recording medium 10 according to the present invention may comprise at least a transfer region 21A with an optically diffractive A image and a transfer region 21X without an optically diffractive image. If necessary, a plurality of image planes of the optically diffractive image transfer region 21, for example, a transfer region 21B with an optically diffractive B image or an optically diffractive n image transfer region 21*n*, wherein "n" represented by A and B for convenience is an integer which is not particularly limited, may be provided.

The transfer region 21A with an optically diffractive A image, a transfer region 21B with an optically diffractive B image, a transfer region 21*n* with an optically diffractive n image, and a transfer region 21X without an optically diffractive image will be collectively referred to as an optically diffractive image transfer region 21. They have the same layer construction and are different from each other only in that the optically diffractive image is different or is absent.

As shown in FIGS. 3 (B) and 3 (C), the layer construction of the intermediate transfer recording medium 10 comprises a base material 11, a peel layer 13, a relief formed layer 15, a transparent thin film layer 17 having a refractive index different from the relief formed layer, and an image receptive layer 19. As shown in FIG. 3 (B), an optically diffractive relief is formed in a relief formed layer 15A in a transfer region 21A with an optically diffractive A image. On the other hand, the layer construction of a transfer region 21X without an optically diffractive image is the same as that of the transfer region 21A with optically diffractive A image, except that, as shown in FIG. 3 (C), a relief formed layer 15X is free from any optically diffractive relief.

Base Material

A base material commonly used in conventional intermediate transfer recording media as such may be used as the base material 11, and the base material 11 is not particularly limited. Specific preferred examples of the base material 11 include: thin papers such as glassine paper, capacitor paper, or paraffin paper; or stretched or unstretched films of plastics, for example, highly heat resistant polyesters such as polyethylene terephthalate, polyethylene naphthalate, polybutylene terephthalate, polypenylene sulfide, polyether ketone, or polyether sulfone, and other plastics such as polypropylene, polycarbonate, cellulose acetate, polyethylene derivative, polyvinyl chloride, polyvinylidene chloride, polystyrene, polyamide, polyimide, polymethylpentene, or ionomers. Composite films comprising two or more of them laminated on top of each other may also be used. The thickness of the base material 11 may be properly selected depending upon the material so as to provide proper strength and heat resistance. In general, however, the thickness of the base material is preferably about 1 to 100 μm. If necessary, a backside layer may be provided by a conventional method on the base material film in its side remote from the transfer part. The backside layer is provided to prevent fusing between the base material film and a heating device such as a thermal head in the transfer of the transfer part onto an object using the intermediate transfer recording medium and to improve sliding properties. The backside layer may be formed of the same resin as used in the prior art.

Peel Layer

Conventional thermoplastic resins, which have a glass transition temperature (Tg) of 150 to 200° C., are at least heat-resistant, and are transparent, may be used as the material for the peel layer 13. Such resins usable herein include cyclic olefin resins, norbornene resins, polycarbonate resins, polyarylate resins, polyamideimide resins (Tg: 200° C. or below), polyetherimide resin (Tg: 200° C. or below), and polysulfone resins. Preferred are cyclic olefin resins. More preferred are norbornene resins. The material for the peel layer may be a copolymer resin composed mainly of the above resin or a mixture (including an alloy). Cyclic olefin resins having a cyclic structure include, for example, (a) norbornene polymers, (b) monocyclic cycloolefin polymers, (c) cyclic conjugated diene polymers, (d) vinyl alicyclic hydrocarbon polymers, and hydrides of the polymers (a) to (d). Among them, norbornene polymer hydrides, vinyl alicyclic hydrocarbon polymers and vinyl alicyclic hydrocarbon polymer hydrides are preferred, for example, from the viewpoint of excellent heat resistance and mechanical strength. More preferred are norbornene polymer hydrides.

The glass transition temperature (Tg) referred to herein refers to a glass transition point determined from a DSC curve based on JIS K 7121: 1987.

A resin incompatible with the heat resistant transparent resin may also be mixed, in an amount of 5 to 30% based on the total solid content of the whole peel layer, in the peel layer. When the resin incompatible with the heat resistant transparent resin is added, a number of dispersed particles or microdomains are formed in the peel layer. This is advantageous in that the separability in the transfer of a hologram is improved, a problem of uneven transfer is eliminated, and the transfer edge part is sharp.

The heat resistant transparent resin contained in the peel layer 13 is preferably a compound having a norbornene structure comprising constitutional units represented by general formula (1).

[Chemical Formula 1]

general formula (1)

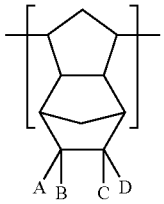

wherein A, B, C, and D represent a hydrogen atom, a hydrocarbon group having 1 to 10 carbon atoms, a halogen atom, a hydrocarbon group having 1 to 10 carbon atoms substituted by a halogen atom, $—(CH_2)_nCOOR_1$, $—(CH_2)_nOCOR_1$, $—(CH_2)_nOR_1$, $—(CH_2)_nCN$, $—(CH_2)_nCONR_3R_2$, $—(CH_2)_nCOOZ$, $—(CH_2)_nOCOZ$, $—(CH_2)_nOZ$, or $—(CH_2)_nW$, or B and C together form —OC—O—CO—, —OC—$NR_4$—CO—, or a (poly)cyclic alkylene group; $R_1$, $R_2$, $R_3$ and $R_4$ represent a hydrocarbon group having 1 to 20 carbon atoms; Z represents a hydrocarbon group substituted by a halogen atom; and W represents $SiR_5\ pF_{3-p}$, wherein $R_5$ represents a hydrocarbon group having 1 to 10 carbon atoms; F represents a halogen atom, —$OCOR_6$ or —$OR_6$, wherein $R_6$ represents a hydrocarbon group having 1 to 10 carbon atoms) and p is an integer of 0 to 3; and n is an integer of 0 to 10.

The above resin having a polynorbornene skeleton is a noncrystalline polyolefin resin due to the structure of the resin and preferably has a number average molecular weight in the range of 50000 to 300000. Specific examples thereof include ARTON G, ARTON F, and ARTON I manufactured by Japan Synthetic Rubber Co., Ltd.

A mixture of the resin having a norbornene skeleton with a resin incompatible with the resin having a norbornene skeleton may also be used.

The resin incompatible with the resin having a norbornene skeleton is not particularly limited so far as the compound is an incompatible compound not fully dissolved in a norbornene addition polymer. Whether or not the resin is incompatible may be determined by a conventional method in the resin industry. For example, when a composition prepared by melt mixing 5 parts by mass of a compound in 100 parts by mass of a norbornene resin is observed under an electron microscope at a magnification of 100000 times, the compound is regarded as incompatible when at least one domain or particle having a size of not less than 1 $mm^2$ is present in an area of 10 cm×15 cm.

In general, resins other than norbornene addition polymers are used as the incompatible compound. Other resins incompatible with the norbornene resin include, for example, polyethers or polythioethers such as polyphenylene sulfides and polyphenylene ethers; polyester polymers such as aromatic polyesters, polyarylates, polyethylene terephthalates, polybutylene terephthalates, polycarbonates, and polyether ketones; chain polyolefin polymers such as polyethylenes, polypropylenes, and poly-4-methyl-pentene-1; general-purpose transparent resins such as polymethylmethacrylates, cyclohexyl methacrylate-methyl methacrylate copolymers, and polyacrylonitrile styrenes (AS resins); acrylic resins; MS resins; and liquid crystalline plastics.

When an incompatible compound is added to a transparent resin having a norbornene structure, in many cases, a number of dispersed microdomains or particles are formed in a coating film formed by coating the mixture.

When microdomains are formed, the average particle diameter [(major axis+minor axis)/2] of the domains observed under an electron microscope is generally 5 to 30 μm, preferably 10 to 20 μm, because the transparency of the film and the transferability in the thermal transfer of a hologram onto an object using a hologram transfer sheet is improved.

In the peel layer 13 in the present invention, preferably, the resin incompatible with the heat resistant transparent resin having a norbornene structure is contained in an amount of 5 to 30% based on the total solid content of the peel layer. When the content of the resin incompatible with the heat resistant transparent resin having a norbornene structure is in the above-defined range, the balance between the heat resistance and transparency of the peel layer and the transferability in the thermal transfer of a hologram onto an object is good.

The resin incompatible with the noncrystalline polyolefin as the heat resistant transparent resin having a norbornene structure is added for enhancing the layer transferability at the time of separation. When the content of the incompatible resin is less than 5% based on the total solid content of the peel layer, the layer cannot be transferred. On the other hand, when the content of the incompatibility resin is more than 30%, due to the incompatible nature, the suitability for coating is deteriorated and, in addition, cracking of the metal thin film layer conformed to the heat deformation of the base material occurs. Accordingly, the content of the incompatible resin is preferably 5 to 20% based on the total solid content of the peel layer.

The peel layer may be formed by providing a coating liquid comprising the above-described heat resistant transparent resin having a norbornene structure, the resin incompatible with the heat resistant transparent resin having a norbornene structure, a solvent, and optionally additives such as waxes and surfactants, coating the coating liquid by conventional means such as gravure printing, screen printing, or reverse coating using a gravure plate, and drying the coating. The thickness of the peel layer is about 0.1 to 2 μm on a dry basis.

Relief Formed Layer

The relief formed layer 15 is a layer having optically diffractive fine concaves and convexes such as a hologram formed on one side of a synthetic resin layer.

Resin materials for the relief formed layer 15 include: thermoplastic resins such as polyvinyl chlorides, acrylic resins (for example, polymethyl methacrylates), polystyrenes, and polycarbonates; cured products of heat curable resins such as unsaturated polyesters, melamines, epoxys, polyester (meth)acrylates, urethane (meth)acrylates, epoxy (meth) acrylates, polyether (meth)acrylates, polyol (meth)acrylates, melamine (meth)acrylates, and triazine acrylates; cured products of ultraviolet curing resins such as compositions prepared by properly mixing an unsaturated ethylene monomer with an unsaturated ethylene oligomer and adding a photopolymerization initiator and a photosensitizing agent; or mixtures of the above resins or thermoformable materials containing a radically polymerizable unsaturated group. Other materials, for example, photosensitive materials such as silver salts, dichromated gelatin, thermoplastics, diazo photosensitive materials, photoresists, ferroelectric materials, photochromic materials, thermochromic materials, and chalcogen glass, are also usable.

Heat curing resins and ultraviolet light, electron beam or other ionic radiation curing resins are particularly preferred from the viewpoint of excellent fastness properties such as chemical, light and weathering fastness. For example, cured products of ionizing radiation curing resins such as epoxy-modified acrylate resins, urethane-modified acrylate resins, and acryl-modified polyester are usable as the ionizing radiation cured resin. Further, copolymer resins composed mainly of these resins or mixtures (including alloys) of these resins may also be used as the ionizing radiation cured resin. The ionizing radiation curing resin preferably has excellent shapability and a suitable level of heat resistance. Preferred are urethane modified acrylate resins. Specifically, the following two urethane modified acrylate resins are preferred.

Ionizing Radiation Curing Resin Composition A

One preferred relief formed layer 15 is a cured product of an uncured ionizing radiation curing resin composition composed mainly of a urethane-modified acrylic resin represented by general formula (a). Specifically, for example, photocuring resin compositions disclosed by the present invention in Japanese Patent Laid-Open No. 273129/2000 can be applied. A photocuring resin composition A described in this publication is used in the working examples in this specification and is described as "ionizing radiation curing resin composition A."

[Chemical Formula 2]

Chemical formula (a)

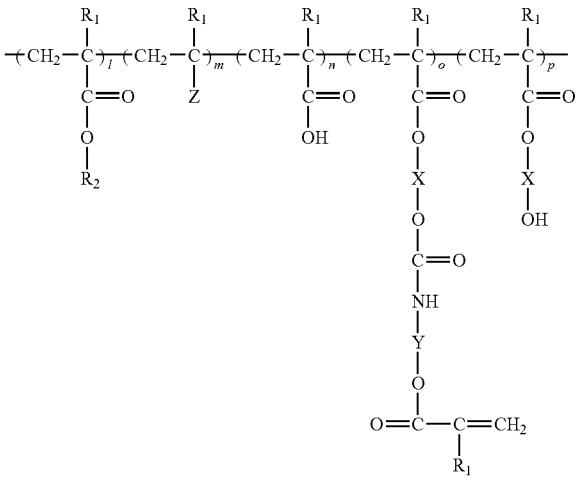

In general formula (a), six R1s each independently represent a hydrogen atom or a methyl group; R2 represents a hydrocarbon group having 1 to 20 carbon atoms; l is an integer of 20 to 90, m is an integer of 0 to 80, n is an integer of 0 to 50, o+p is an integer of 10 to 80, and p is an integer of 0 to 40, provided that the total of l, m, n, o and p is 100; X and Y represent a straight chain or branched chain alkylene group; and Z represents a group for modifying a urethane modified acrylic resin, preferably a group having a bulky cyclic structure.

Ionizing Radiation Curing Resin Composition B

A photocuring resin disclosed in Japanese Patent Laid-Open No. 329031/2001 can be applied as another one preferred example of the relief formed layer 15. In the working example in this specification, this photocuring resin is described as "ionizing radiation curing resin composition B."

Specifically, a cured product of an ionizing radiation curing resin containing a urethane (meth)acrylate oligomer is preferred. More preferably, the urethane (meth)acrylate oligomer is a reaction product of (1) an isocyanate compound having in its molecule at least three isocyanate groups, (2) a polyfunctional (meth)acrylate having in its molecule at least one hydroxyl group and at least two (meth)acryloyloxy groups, and (3) a polyhydric alcohol having in its molecule at least two hydroxyl groups. A mixture of the urethane (meth) acrylate oligomer with other thermoplastic resin may be used as the ionizing radiation curing resin, and a mixture of the urethane (meth)acrylate oligomer with an acrylic resin is most preferred.

An ionizing radiation curing resin, which is not sticky in a coated state before curing with an ionizing radiation, is curable with an ionizing radiation, can easily be shaped to form a relief structure, and is curable with an ionizing radiation after the shaping into the relief structure, is preferred. More specifically, the use of an ionizing radiation curing resin, which is a reaction product of an isocyanate compound having a melting point of 40° C. or above with an (meth)acrylic compound containing an (meth)acryloyl group and reactive with an isocyanate group and contains a thermoplastic resin having a softening point of 40° C. or above, is preferred.

Further, the heat resistance of the ionizing radiation cured resin constituting the relief formed layer 15 is such that the glass transition temperature (Tg) is proper and is preferably 70 to 100° C. When the ionizing radiation cured resin has heat resistance on a level above the upper limit of this heat resistance level range, the layer is hard and has lowered shapability. On the other hand, when the ionizing radiation cured resin has heat resistance on a level below the lower limit of this heat resistance level range, the shaped relief structure is deformed, for example, by heat applied in the transfer and is deformed resulting in deteriorated properties.

Relief

The relief has a concave-convex shape and is not particularly limited. The shape of the relief, however, is preferably such that fine concaves and convexes are present and functions such as light diffusion, light scattering, light reflection, and light diffraction are developed. Examples thereof include those with a Fourier transformation or lenticular lens, a light diffraction pattern, or a moseye structure formed therein. Further, patterns which develop unique brilliance although the optical diffraction function is not developed, for example, hairline patterns, matte patterns, full line patterns, or interference patterns are also possible. Holograms or diffraction gratings in which interference fringes produced by interference between object light with reference light have been recorded in a concave-convex pattern can be applied as the optically diffractive concave-convex pattern. Holograms include laser reproducible holograms such as Fresnel holograms, white light reproducible holograms such as rainbow holograms, and, further, color holograms, computer generated holograms (CGH), and holographic diffraction gratings which utilize the principle of the above holograms.

Holographic diffraction gratings utilizing hologram recording means may also be mentioned as the diffraction grating. Diffraction gratings, which have been mechanically prepared using an electron beam exposure system and can provide any desired diffracted light based on calculation, may be further mentioned as the diffraction grating. Machining may also be adopted. These holograms and/or diffraction gratings may be recorded solely or in a multiple form, or in combination. These original plates can be prepared using conventional materials and methods. In general, for example, a laser beam interference method using a glass plate coated with a photosensitive material, an electron beam exposure method using a glass plate coated with an electron beam resist material, and a machining method are applicable.

The hologram on the layer formed of a resin can be formed by a conventional method using the above material. For example, when interference fringes of diffraction gratings or holograms are recorded as a relief of surface concaves and convexes, a concave-convex pattern of an original plate can be replicated by providing, as a press die, an original plate with diffraction gratings or interference fringes being recorded as concaves and convexes, placing the original plate on the resin layer, and bonding them to each other by heat contact bonding using suitable means such as a heating roller. When a photopolymer is used, replication can be carried out by coating a photopolymer onto a hologram transfer sheet and then placing the original plate on the coating, and exposing the assembly to a laser beam.

The thickness of the relief formed layer is preferably in the range of 0.1 to 6 μm, more preferably in the range of 0.1 to 4 μm.

Transparent Thin Film Layer

In the transparent thin film layer 17 having a refractive index different from the relief formed layer, the hue is substantially colorless and transparent, and the optical refractive index is different from that of the relief formed layer. Accordingly, despite freedom from metallic luster, brilliance of holograms or the like can be viewed, and, thus, a transparent thin film layer, which has brilliance such as holograms, can be prepared.

A thin film having a higher photorefractive index than the relief formed layer 15 and a thin film having a lower photorefractive index than the relief formed layer 15 are possible. Examples of the former thin film include thin films of ZnS, $TiO_2$, $Al_2O_3$, $Sb_2S_3$, SiO, $SnO_2$, and ITO, and examples of the latter thin films include thin films of LiF, $MgF_2$, and $AlF_3$. Further, conventional photoreflective metal thin films of aluminum having a thickness of not more than 200 angstroms are transparent and thus are usable. A transparent metal compound may be formed in the same manner as in the formation of a metal thin film, that is, by forming a film by a vacuum thin film formation method such as vapor deposition, sputtering, ion plating, or CVD onto the surface of the relief in the relief formed layer 15 to a thickness of about 10 to 2000 nm, preferably 20 to 1000 nm. Further, a transparent synthetic resin having a photorefractive index different from the relief formed layer 15 may be used.

Receptive Layer

An image receptive layer 19 may be provided directly on the transparent thin film layer when the image receptive layer 19 per se is adhesive. In general, a primer layer is formed between the transparent thin film layer and the receptive layer to improve the adhesion between the image receptive layer 19 and the transparent thin film layer. An image is formed on the receptive layer by thermal transfer from a thermal transfer sheet comprising a coloring material layer. The transfer part in the intermediate transfer recording medium with an image formed thereon is transferred onto an object, whereby printed matter is formed. Preferred materials for receptive layer formation include materials, which are highly receptive to thermally transferable coloring materials such as sublimable dyes or heat-fusion inks, and materials having adhesion to objects. Examples thereof include polyolefin resins such as polypropylene, vinyl resins such as polyvinyl chloride, polyvinylidene chloride, polyvinyl chloride-vinyl acetate copolymer, and polyvinyl acetate, polyester resins such as polyethylene terephthalate and polybutylene terephthalate, polyacrylic ester resin, polystyrene resins, polyamide resins, acetal resins, butyral resins, copolymers of olefins such as ethylene or propylene with other vinyl monomers, ionomers, and cellulose derivatives. They may be used either solely or as a mixture of two or more. Among them, vinyl resins and polyester resins are particularly preferred.

The incorporation of a release agent in the above resin is preferred from the viewpoint of preventing heat fusing between the receptive layer and the coloring material layer in the thermal transfer film in the formation of a dye image on the receptive layer. Release agents usable herein include silicone oils, phosphate surfactants, and fluorocompounds. Among them, silicone oils are particularly preferred. The amount of the release agent added is preferably 0.2 to 30 parts by weight based on 100 parts by weight of the resin for receptive layer formation.

The receptive layer may be formed by optionally adding various additives and the like to a single or plurality of materials selected from the above materials, dissolving or dispersing the material in a suitable solvent such as water or an organic solvent to prepare a coating liquid for a receptive layer, coating the coating liquid by means such as gravure printing, screen printing or reverse coating using a gravure plate, drying the coating. The thickness of the receptive layer is about 1 to 10 μm on a dry basis.

Step S2 is (2) the step of providing a thermal transfer sheet with an adhesive layer, comprising at least a base material film, and a thermally transferable coloring material layer having at least one image plane, and a separable heat-adhesive layer transfer part provided on the base material film, the thermally transferable coloring material layer and the heat-adhesive layer transfer part being set.

Thermal Transfer Sheet with Adhesive Layer

Figure 4:
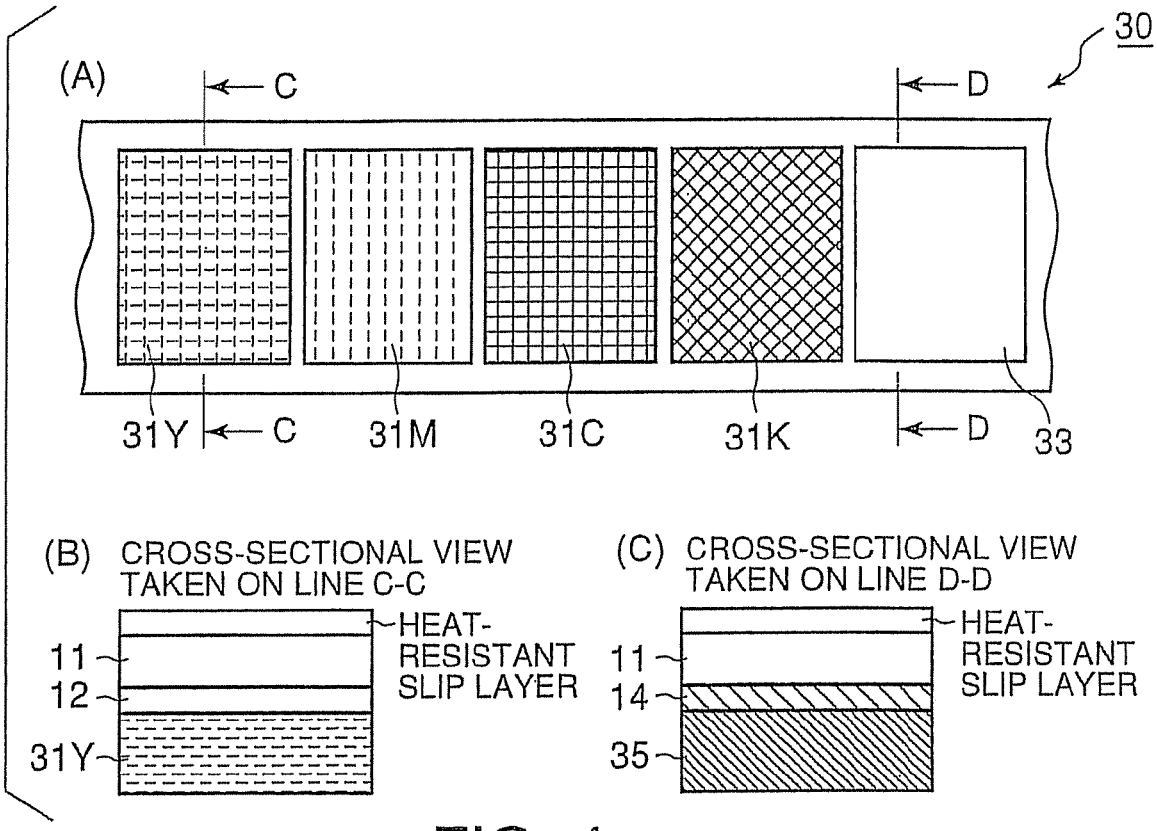
FIG. 4 is a plane view and a cross-sectional view of a thermal transfer sheet with an adhesive layer for use in the present invention.
Figure 5:
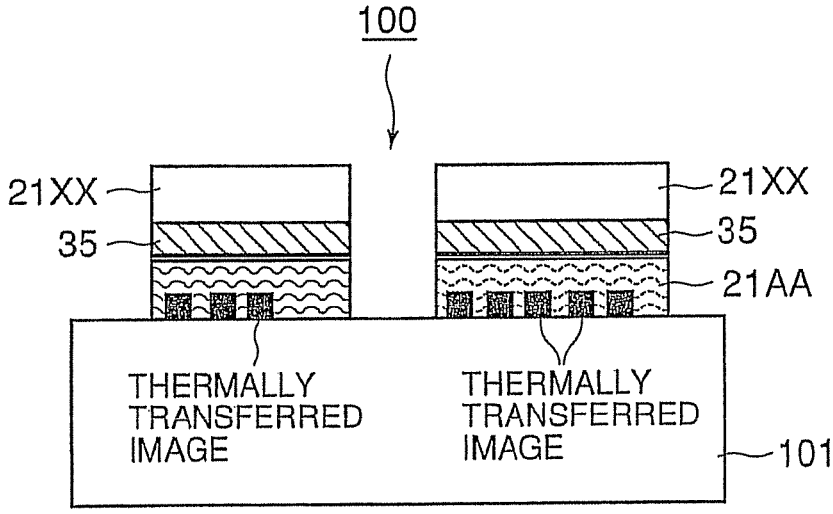
FIG. 5 is a cross-sectional view of an image formed object according to the present invention.

As shown in FIG. 4 (A), a thermal transfer sheet 30 with an adhesive layer comprises at least one coloring material layer region 31 and a heat-adhesive layer region 33.

The thermal transfer sheet 30 in its part having the coloring material layer region 31 may be the conventional so-called "thermal transfer sheet," and the coloring material layer provided in the thermal transfer sheet is formed by an ink containing a heat-fusion ink or a sublimable dye. If necessary, a plurality of regions may be provided in the coloring material layer region 31. For example, three primary color regions, that is, a Y coloring material layer region 31Y, an M coloring material layer region 31M, and a C coloring material layer region 31C, and additionally a black K coloring material layer region 31K may be provided.

The thermal transfer sheet 30 with an adhesive layer comprises one or a plurality of coloring material layer regions 31 in the above so-called "thermal transfer sheet" and a heat-adhesive layer region 33 provided face-serially with the colorant material layer region(s).

As shown in FIG. 4 (B), the coloring material layer region 31 in the thermal transfer sheet 30 with an adhesive layer has a layer construction comprising at least a base material 11 and a coloring material layer 31. If necessary, a primer layer 12 may be provided between the base material 11 and the coloring material layer 31. A heat-resistant slip layer may be provided on the base material layer in its side remote from the coloring material layer from the viewpoint of preventing adverse effect such as sticking, cockling of prints or the like caused by heat of a thermal head. The coloring material layer 31 contains a colorant depending upon color. As shown in FIG. 4 (C), the heat-adhesive layer region 33 has a layer construction comprising at least a heat-resistant slip layer, a base material 11, a release layer 14, and a heat-adhesive layer 35.

Heat-Resistant Slip Layer

The resin for heat-resistant slip layer formation may be any conventional resin, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetate propionate resins, cellulose acetate butyrate resins, cellulose acetate hydrogenphthalate resins, cellulose acetate resins, aromatic polyamide resins, polyimide resins, polyamide-imide resins, polycarbonate resins, and chlorinated polyolefin resins.

Slipperiness-imparting agents added to or coated onto the top of the heat-resistant slip layer formed of these resins include phosphoric esters, metallic soaps, silicone oils, graphite powders, silicone graft polymers, fluoro graft polymers, acrylic silicone graft polymers, acrylsiloxanes, arylsiloxanes, and other silicone polymers. Preferably, the heat-resistant slip layer is formed of a polyol, for example, a polyalcohol polymer compound, a polyisocyanate compound, or a phosphoric ester compound. Further, the addition of a filler is more preferred.

The heat-resistant slip layer may be formed by dissolving or dispersing the above resin, slipperiness-imparting agent, and filler in a suitable solvent to prepare a coating liquid for a heat-resistant slip layer, coating the coating liquid onto the base material film, for example, by the same means for the formation of other layers, such as gravure printing, screen printing, or reverse roll coating using a gravure plate, and drying the coating. The coverage of the heat-resistant slip layer is preferably 0.1 to 3.0 g/m$^2$ on a dry basis. The primer layer as described above may be provided between the heat-resistant slip layer and the base material film.

Coloring Material Layer

The coloring material layer comprises a dye, which is mainly thermally transferable by sublimation, supported, for example, on a binder resin. In this case, any conventional dye commonly used in thermal transfer films can be effectively used, and the dye is not particularly limited. The following dyes may be mentioned as preferred dyes. Specifically, for example, MS Red G, Macrolex Red Violet R, Ceres Red 7B, Samaron Red HBSL, and Resolin Red F3BS may be mentioned as magenta dyes. For example, Phorone Brilliant Yellow 6 GL, PTY-52, Solvent Yellow 93, and Macrolex Yellow 6G and the like may be mentioned as yellow dyes. For example, Kayaset Blue 714, Waxoline Blue AP-FW, Phorone Brilliant Blue S-RR, and MS Blue 100 may be mentioned as cyan dyes. Any conventional binder resin may be used for supporting the above dyes, and examples of preferred binder resins include: cellulosic resins such as ethylcellulose, hydroxyethylcellulose, ethylhydroxycellulose, hydroxypropylcellulose, methylcellulose, cellulose acetate, and cellulose butyrate; vinyl resins such as polyvinyl alcohol, polyvinyl acetate, polyvinyl butyral, polyvinyl acetal, polyvinyl pyrrolidone, and polyacrylamide; and polyester resins. Among them, for example, cellulosic resins, vinyl resins such as polyvinyl butyral and polyvinyl acetal, and polyester resins are preferred from the viewpoints of heat resistance, transferability of dyes and the like.

Further, if necessary, various conventional other additives may be incorporated into the thermally sublimable coloring material layer.

The content of the dye is generally about 5 to 90%, preferably about 10 to 70%, based on the total amount of the thermally sublimable coloring material layer.

The thermally sublimable coloring material layer is preferably formed by adding the above sublimable dye, binder resin, and other optional components to a suitable solvent for dissolution or dispersion of the components to prepare a coating material or ink for thermally sublimable coloring material layer formation, coating the coating material or ink onto the above base material film in a face serial manner and drying the coating.

The thickness of the thermally sublimable coloring material layer is generally about 0.2 to 5 μm, preferably about 0.4 to 2 μm.

A heat-fusion coloring material layer may also be used as the coloring material layer. In this case, the heat-fusion coloring material layer comprises a colorant supported on a binder.

Among organic or inorganic pigments and dyes, those having good properties as a recording material, for example, those, which have satisfactory color density and do not cause color change and fading upon exposure to light, heat, and temperature or the like, are preferred as the colorant. For example, colorants having black, cyan, magenta, yellow, and other hues are usable as such colorants.

The binder used is, for example, composed mainly of wax and further comprises a mixture of a drying oil, a resin, a mineral oil, a cellulose derivative, a rubber derivative and the like.

Waxes usable herein include various waxes such as microcrystalline wax, carnauba wax, paraffin wax, Fischer-Tropsh wax, various types of low-molecular weight polyethylene, Japan wax, beeswax, spermaceti, insect wax, wool wax, shellac wax, candelilla wax, petrolactum, polyester wax, partially modified wax, fatty esters, and fatty amides.

A vinyl chloride-vinyl acetate copolymer resin, an acrylic resin, a chlorinated rubber, a vinyl chloride-vinyl acetate copolymer resin, a cellulosic resin or the like may also be used as the binder.

The heat-fusion coloring material layer may be formed, by adding the above colorant, binder resin, and optional other additives to prepare a composition for heat-fusion coloring material layer formation, coating the composition onto the above base material film by hot melt coating, hot lacquer coating, gravure coating, gravure reverse coating, knife coating, air coating, roll coating or the like and drying the coating.

The thickness of the heat-fusion coloring material layer is generally about 0.1 to 8 μm, preferably about 0.4 to 2 μm.

The heat-fusion coloring material layer formed on the base material film may have a single-layer structure or a multilayer structure of two or more layers.

In the present invention, a primer layer may be provided between the base material film and the thermally sublimable coloring material layer. Further, in the present invention, a peel layer may be provided between the base material film and the heat-fusion coloring material layer. A combination of a thermally sublimable dye coloring material layer with a heat-fusion coloring material layer may be provided as the coloring material layer.

Heat-Adhesive Layer

The adhesive layer 35 is provided to provide strong adhesion between the peel layer in the intermediate transfer recording medium exposed by the first transfer and a layer formed by the second transfer. Examples of materials usable for the adhesive layer 35 include a wide variety of materials known as conventional adhesives, for example, vinyl chloride resins, vinyl chloride-vinyl acetate copolymer resins, acrylic resins, urethane resins, amide resins, epoxy resins, rubber-based resins, and ionomer resins. The thickness of the adhesive layer 35 is 0.1 to 50 μm, preferably 1 to 10 μm. If necessary, a release layer formed of, for example, a silicone resin or a fluororesin may be provided between the base material film and the heat-adhesive layer.

In step S3, (3) a thermally transferred image is formed on an image receptive layer on the intermediate transfer recording medium using a thermally transferable coloring material layer in the thermal transfer sheet with an adhesive layer.

A coloring material layer 31 in a thermal transfer sheet 30 with an adhesive layer is put on a receptive layer 19 surface in a transfer part region 21A with an optically diffractive image in an image plane having an optical diffraction structure in the (thermally transferable image) intermediate transfer recording medium 10 to form a desired thermally transferred image.

At the outset, the intermediate transfer intermediate medium 10 with a diffraction structure prepared above and the coloring material layer in the thermal transfer sheet 30 with an adhesive layer prepared above are placed between a heating device such as a thermal head and a platen roll, the assembly is pressed so that the transfer part in the intermediate transfer recording medium 10 with a diffraction structure comes into contact with the coloring material layer 31 in the thermal transfer sheet 30 with an adhesive layer, and a heat generating part in the heating device is selectively heated according to image information for transfer and migration of the coloring material of the coloring material layer 31 in the thermal transfer sheet 30 with an adhesive layer to record an image.

In step S4, (4) the transfer part in the intermediate transfer recording medium with a thermally transferred image formed thereon is transferred onto an object.

As described above, an object with an image having an optical diffraction structure can be formed by placing the transfer part region 21A with an optically diffractive image having a thermally transferred image formed on its surface on an object and pressing the assembly so that the receptive layer 19 surface in the transfer part region 21 comes into contact with the object, whereby a plurality of layers, that is, the peel layer, the relief formed layer, and the transparent thin film layer having a refractive index different from the relief formed layer and the receptive layer are transferred onto the object 101 by heating means such as a thermal head, a hot stamp or a hot roll. A thermal head or a hot stamp is preferably used as the above heating means in partial transfer. On the other hand, in the transfer on the whole area of the object, the adoption of a hot roll is preferred.

In step S5, (5) the heat-adhesive layer part in the thermal transfer sheet with an adhesive layer is transferred onto the transfer part in the optically diffractive image-free image plane in the intermediate transfer recording medium to form a heat-adhesive layer.

The intermediate transfer recording medium 10 with a diffraction structure used in step S3 and the thermal transfer sheet 30 with an adhesive layer used in step S3 are put on top of each other so that the receptive layer 19 surface in the optically diffractive image-free transfer part region 21X in the optically diffractive image-free image plane of the intermediate recording medium 10 comes into contact with the heat-adhesive layer 35 in the heat-adhesive layer region 33 of the thermal transfer sheet 30 with an adhesive layer, followed by pressing of the assembly, whereby the heat-adhesive layer 35 is transferred by heating means such as a thermal head or a hot stamp or a hot roll.

In step S6, (6) the optically diffractive image-free transfer part in the intermediate transfer recording medium with a heat-adhesive layer formed thereon is transferred through the heat-adhesive layer so as to cover the transferred part provided in step S4 in the optically diffractive image-provided image plane with a thermally transferred image formed thereon on the object.

An optical diffraction-free transfer part region 21X with a heat-adhesive layer 35 transferred thereon is previously prepared in step S5, and the heat-adhesive layer 35 surface is placed so that the heat-adhesive layer 35 surface comes into contact with the surface of the peel layer 13, in the intermediate transfer recording medium with an optically diffractive image, transferred onto the object in step S4, and the assembly is pressed by heating means such as a thermal head, a hot stamp, or a heat roll for transfer.

When a plurality of optically diffractive image-provided transfer part regions are present (21*n* wherein n is an integer), an image formed object with a plurality of optically diffractive image-provided transfer parts transferred thereon can be formed by forming any desired thermal transfer image on the receptive layer 19 surface in at least one optically diffractive image-provided transfer part regions, forming the heat-adhesive layer region 33 in the thermal transfer sheet 30 with an adhesive layer in number corresponding to n image planes, and repeating a series of steps from step S4 to step S6 by n times.

Transfer Apparatus

In the above steps 1 to 6, two times of intermediate transfer and two times of transfer onto an object can be carried out by a single running operation. That is, after use in first transfer on an object 101 in step 4, an intermediate transfer recording medium 10 with a diffraction structure and a thermal transfer sheet 30 with an adhesive layer which have been rewound are again used for intermediate transfer in step S5. Subsequently, second transfer is carried out in step S6. Thus, a final image formed object 100 having durably protected optical diffraction structure and thermally transferred image can be prepared by using two medium and a single transfer apparatus.

Printed Matter

In the image formed object 100 thus obtained, transfer can be carried out even on the peel layer 13 surface formed of a heat resistant resin with high adhesion by transfer through the heat-adhesive layer 35. Accordingly, the image formed object has satisfactory fastness properties on such a level that, even when the image formed object is used under severe conditions, the thermally transferred image can be protected. As shown in FIG. 4, in secondly transferred heat-adhesive layer 35/transparent thin film layer 17 having a refractive index different from the relief formed layer/relief formed layer 15/peel layer 13, the relief formed layer 15 and the peel layer 13, which are particularly excellent in fastness properties such as fastness to heat, scratch, abrasion, chemicals and the like, constitute the outermost surface, and, thus, the image formed object has high fastness properties.

Further, the use of the intermediate transfer recording medium 10 with a diffraction structure is advantageous in that, since an image-formed receptive layer can be transferred onto an object, the coloring material is less likely to migrate. Accordingly, this construction is preferred for use, for example, with an object on which a high-quality image cannot be directly formed, or an object which is likely to fuse to the coloring material layer in the thermal transfer.

Further, a printed matter can also be prepared by previously writing or printing necessary matter such as a signature onto an object and then transferring an intermediate transfer recording medium in its transfer part with images such as characters or photographs formed thereon. Accordingly, the intermediate transfer recording medium is preferably used for the preparation of printed matters such as identifications such as passports, credit cards/ID cards and the like. Security, that is, high reliability/safety against forgery or alteration, is required of printed matters such as the passports and credit cards. To meet this demand, various methods have been proposed for rendering, for example, forgery or alteration by copying difficult.

Further, in order to prevent forgery or alteration of printed matters such as passports or credit cards, an intermediate transfer recording medium comprising a hologram pattern, applications concerning a microcharacter or the like provided on a transfer part, and a printed patter produced by transferring this transfer part to an object have already been filed (Japanese Patent Laid-Open No. 254844/1999 and Japanese Patent Laid-Open No. 15939/2000). According to these applications, the transfer of the hologram pattern or microcharacter provided in the transfer part, together with the image onto an object, makes it difficult to forge or alter images such as characters or a photograph of the face formed on a printed matter, contributing to a high level of reliability and safety.

EXAMPLES

The following Examples and Comparative Examples further illustrate the present invention. However, it should be noted that the present invention is not limited to these Examples.

Example 1

A 16 μm-thick polyester terephthalate film (tradename: S-28, manufactured by Toray Industries, Inc.) was provided as a base material. The following composition for a peel layer was coated by a gravure reverse coater onto one side of the base material to a thickness of 0.8 μm on a dry basis, and the coating was dried at 80° C. to form a peel layer 13. The following composition for relief formation layer was coated by a gravure reverse coater onto the surface of the peel layer 13 to a thickness of 2.5 μm on a dry basis, and the coating was dried at 100° C. to form a relief formation layer 15. The assembly can be stored or post-processed in a wound state. A stamper was pressed against the surface of the relief formation layer 15 for embossing to shape a relief. Separately, a resin stamper replicated by a 2P method from a hologram photographed by a two-beam method is applied to an emboss roller in a replication apparatus, and the assembly was heat pressed for embossing between opposed rollers at 150° C. to form the shape of a relief formed of a fine concave-convex pattern. In this case, as shown in FIG. 2, the relief was formed so as to have a two-image plane construction of which the first image plane had an image A and the second image plane had no relief. Immediately after shaping, ultraviolet light was applied using a high-pressure mercury lamp for curing. Titanium oxide was vacuum deposited onto the surface of the relief to a thickness of 50 nm to form a reflective layer 17. The following coating composition for an image receptive layer was coated onto the surface of the reflective layer 17, and the coating was dried to form a 2.0 μm-thick image receive layer 19. Thus, an intermediate transfer recording medium was prepared.

<Coating Liquid for Peel Layer>

| | |
|---|---|
| Norbornene resin (tradename: ARTON G, manufactured by JSR Corporation) (Tg; 171° C.) | 40.0 parts |
| Acrylic polyol resin (Thermolac SU-100A, manufactured by Soken Chemical Engineering Co., Ltd.) | 10.0 parts |
| Toluene/methyl ethyl ketone (mass ratio 7/3) | 50.0 parts |

<Composition for Relief Formed Layer>

| | |
|---|---|
| Photocurable resin composition B (Example 1 in in Japanese Patent Laid-Open No. 329031/2001) | 100.0 parts |
| Silicone | 1.0 part |
| Photopolymerization initiator (Irgacure 907, manufactured by Ciba Specialty Chemicals, K.K.) | 5.0 parts |
| Methyl ethyl ketone | 100 parts |

<Coating Liquid for Image Receptive Layer>

| | |
|---|---|
| Vinyl chloride-vinyl acetate copolymer (SOLBIN CNL, manufactured by Nissin Chemical Industry Co., Ltd.) | 40 parts |

-continued

| | |
|---|---|
| Acrylic silicone (KP1800U, manufactured by The Shin-Etsu Chemical Co., Ltd.) | 1.5 parts |
| Solvent (methyl ethyl ketone:toluenne = 1:1) | 100 parts |

(Preparation of Heat-Adhesive Layer Sheet)

Next, a heat-adhesive layer transfer sheet was prepared as follows.

A 6 μm-thick polyethylene terephthalate film (an easy-adhesion treated product, manufactured by Toray Industries, Inc.) was provided. An ink for heat-resistant slip layer having the following composition was gravure coated (coverage 1.0 g/m$^2$ on a dry basis) onto one side of the polyethylene terephthalate film, and the coating was dried. The dried coating was then cured to form a backside layer.

<Coating Liquid for Heat-Resistant Slip Layer>

| | |
|---|---|
| Polyvinyl butyral (BX-1, manufactured by Sekisui Chemical Co., Ltd.) | 15 parts |
| Polyisocyanate (Burnock D450, manufactured by Dainippon Ink and Chemicals, Inc.) | 35 parts |
| Phosphoric ester surfactant (Plysurf A208S, manufactured by Dai-Ichi Kogyo Seiyaku Co., Ltd.) | 10 parts |
| Talc (Microace P-3, manufactured by Nippon Talc Co., Ltd.) | 3 parts |

Further, a heat-adhesive layer 33 region was provided on the surface of the polyethylene terephthalate film remote from the heat-resistant slip layer. The heat-adhesive layer 33 was formed as follows. The following coating liquid for a release layer was gravure coated to a thickness of 0.7 μm on a dry basis, and the coating was dried to form a release layer 13. The following coating liquid for a heat-adhesive layer was gravure coated onto the surface of the release layer 13 to a thickness of 1 μm on a dry basis, and the coating was dried to form a heat-adhesive layer 35.

<Coating Liquid for Release Layer>

| | |
|---|---|
| Silicone modified acrylic resin (CELTOP 226, manufactured by Daicel Chemical Industries, Ltd.) | 16 parts |
| Aluminum catalyst (CELTOP CAT-A, manufactured by Daicel Chemical Industries, Ltd.) | 3 parts |
| Solvent (methyl ethyl ketone:toluene = 1:1) | 16 parts |

<Coating Liquid for Heat-Adhesive Layer>

| | |
|---|---|
| Vinyl chloride-vinyl acetate copolymer (SOLBIN CNL, manufactured by Nissin Chemical Industry Co., Ltd.) | 20 parts |
| Solvent (ethyl acetate:toluene = 1:1) | 20 parts |

The above intermediate transfer recording medium, and a color sublimable ink ribbon in a card printer HDP820 manufactured by FARGO on which the above heat-adhesive layer transfer sheet had been cut and pasted in a face serial manner as shown in FIG. 3, were provided. A thermally transferred image (a photograph of the face) was formed on a transfer part in an image plane having an optically diffractive structure of the intermediate transfer recording medium, using the thermally transferable coloring material layer in the above thermal transfer sheet with an adhesive layer, by the card printer HDP820 manufactured by FARGO. The transfer part with a thermally transferred image formed thereon was transferred onto an object. The heat-adhesive layer part in the thermal transfer sheet with an adhesive layer was transferred onto the transfer part in an optical diffraction structure-free image plane in the intermediate transfer recording medium to form a heat-adhesive layer. The heat-adhesive layer-formed transfer part was transferred through the heat-adhesive layer so as to cover the transfer part in the optical diffraction structure-provided image plane with a thermally transferred image formed thereon on the object. Thus, an image formed object of Example 1 was prepared.

Comparative Example 1

The intermediate transfer recording medium of Example 1 and a color sublimable ink ribbon in a card printer HDP820 manufactured by FARGO were provided. A thermally transferred image (a photograph of the face) was formed on a transfer part in an image plane having an optical diffraction structure of the intermediate transfer recording medium, using the thermally transferable coloring material layer in the thermal transfer sheet. The transfer part with a thermally transferred image formed thereon was transferred onto an object. The transfer part in the optical diffraction structure-free image plane in the intermediate transfer recording medium was transferred so as to cover the transfer part in the optical diffraction structure-provided image plane with a thermally transferred image formed thereon on the object. Thus, an image formed object was prepared.

Comparative Example 2

The intermediate transfer recording medium of Example 1 and a color sublimable ink ribbon in a card printer HDP820 manufactured by FARGO were provided. A thermally transferred image (a photograph of the face) was formed on a transfer part in an image plane having an optically diffractive structure of the intermediate transfer recording medium, using the thermally transferable coloring material layer in the thermal transfer sheet. The transfer part with a thermally transferred image formed thereon was transferred onto an object. Thus, an image formed object was prepared.

Evaluation Method

Evaluation was carried out for abrasion resistance, lightfastness, water immersion test, folding test, and plasticizer resistance. The results are shown in Table 1.

The abrasion resistance was determined by providing Taber Abraser 5130 manufactured by Toyo Seiki Seisaku Sho, Ltd. and determining the number of revolutions necessary for abrading the thermally transferred image under conditions of truck wheel CS-10F and load 250 gf.

For the lightfastness, Super Xenon Weather Meter manufactured by Suga Test Instruments Co., Ltd. was provided, quartz of # 275 was used in a filter, and ΔE value after 168 hr was measured at an irradiance of 48 $W/m^2$.

The ΔE value was determined by measuring a color difference of an image between before and after xenon irradiation with a color difference meter (CR-2321, manufactured by Minolta Co., Ltd.). That is, L* value, a* value, and b* value of the image before and after the irradiation were measured, and a color difference change ΔLab was calculated by equation 1. The results of measurement and the calculated ΔLab values are shown in Table 1 below.

$$\Delta Lab=[(\Delta L^*)2+(\Delta a^*)2+(\Delta b^*)2]1/2 \quad \text{equation 1}$$

The plasticizer resistance was carried out using DOP (dioctyl phthalate) as a plasticizer according to TEST 5.14 in ANSI/INCITS 322. In this case, when the dye was eroded by the plasticizer, that is, when bleeding or the like was observed, the plasticizer resistance was regarded as unacceptable.

TABLE 1

| | Abrasion resistance | Light-fastness | Water immersion test | Folding test | Plasticizer resistance |
|---|---|---|---|---|---|
| Ex. 1 | 2000 | 15.7 | ○ | ○ | ○ |
| Comp. Ex 1 | 1700 | 15.7 | x (Lifted) | x (Cracked) | x |
| Comp. Ex 2 | 1000 | 38.4 | ○ | ○ | x |

Results of Evaluation

For the image formed objects of Example 1 and Comparative Examples 1 and 2, both an optical diffraction structure of a hologram and an image formed by thermal dye transfer (sublimation transfer) could be transferred and formed onto a vinyl chloride card and, at the same time, the image formed objects were free from cracking and unevenness of the metal thin film layer and had a high level of design.

In the image formed object of Comparative Example 1, due to unsatisfactory adhesion between the first transferred layer and the second transferred layer, cracking was observed in the folding test, and lifting was observed in the water immersion test. The image formed object of Comparative Example 2 was poor in fastness to abrasion, plasticizer, and light. In Example 1, the layer transferred by the first transfer was not separated from and strongly adhered to the layer transferred by the second transfer, and, thus, an image formed object possessing excellent fastness to abrasion, plasticizer and light was prepared.

What is claimed is:

1. A method for image formation, comprising the steps of:

(1) providing an intermediate transfer recording medium comprising a base material film and a transfer part provided separably on said base material film, said transfer part comprising at least an optical diffraction structure;

(2) providing a thermal transfer sheet comprising a base material film and, provided on said base material film in a surface serial manner, at least one thermally transferable coloring material layer and a separably provided heat-adhesive layer transfer part;

(3) forming a thermally transferred image on the surface of the optical diffraction structure of said transfer part of said intermediate transfer recording medium using the thermally transferable coloring material layer of said thermal transfer sheet;

(4) transferring said transfer part of said intermediate transfer recording medium that has the thermally transferred image formed thereon in step (3) onto an object;

(5) forming a heat adhesive layer on another transfer part of said intermediate transfer recording medium that was next to said transfer part having said optical diffraction structure of said intermediate transfer recording medium used in step (3), using said heat-adhesive layer transfer part of said thermal transfer sheet used in step (3); and (6) transferring said another transfer part having said heat adhesive layer formed thereon in step (5) onto said transfer part transferred onto the object in step (4) through the heat adhesive layer so as to cover the transferred part having the thermally transferred image formed thereon in step (4) on the object with said another transfer part formed in step (5).

2. The method for image formation according to claim 1, wherein said optical diffraction structure is a hologram or a diffraction grating and the thermally transferred image is an image formed by a heat-fusion transfer method or a thermal dye transfer method.

* * * * *